US007581648B2

(12) United States Patent
Greenbank et al.

(10) Patent No.: US 7,581,648 B2
(45) Date of Patent: Sep. 1, 2009

(54) POTATO SORTING APPARATUS

(76) Inventors: Martin Paul Greenbank, 3169 Sweetwater Dr., Boise, ID (US) 83716; William Todd Grimes, 1632 W. Georgia, Nampa, ID (US) 83686; George Mendenhall, 4252 W. Eagleson Rd., Boise, ID (US) 83705

( * ) Notice: Subject to any disclaimer, the term of this patent is extended or adjusted under 35 U.S.C. 154(b) by 253 days.

(21) Appl. No.: 11/292,994

(22) Filed: Dec. 2, 2005

(65) Prior Publication Data

US 2007/0000823 A1 Jan. 4, 2007

Related U.S. Application Data

(60) Provisional application No. 60/691,525, filed on Jun. 17, 2005.

(51) Int. Cl.
*B07C 5/06* (2006.01)

(52) U.S. Cl. ..... 209/621; 209/669

(58) Field of Classification Search ..... 209/621, 209/622–624, 659, 660, 666–673
See application file for complete search history.

(56) References Cited

U.S. PATENT DOCUMENTS

| | | | | |
|---|---|---|---|---|
| 785,748 | A | 3/1905 | Maull | |
| 1,148,165 | A | 7/1915 | Hardie | |
| 1,275,513 | A | 8/1918 | Whitehead | |
| 1,350,794 | A | 8/1920 | Eby et al. | |
| 1,403,597 | A | 1/1922 | Evans | |
| 1,461,265 | A | 7/1923 | Bullard | |
| 1,882,130 | A * | 10/1932 | Fielder | 209/669 |
| 2,425,478 | A | 8/1947 | Lawton et al. | |
| 4,081,362 | A | 3/1978 | Chamberlin et al. | |
| 4,205,752 | A | 6/1980 | Malvick et al. | |
| 4,213,533 | A | 7/1980 | Sardo | |
| 4,353,455 | A | 10/1982 | Mumma et al. | |
| 4,454,030 | A * | 6/1984 | Young | 209/669 |
| 4,979,624 | A | 12/1990 | Ellis | |
| 5,373,947 | A | 12/1994 | Nakamura et al. | |
| 5,524,796 | A * | 6/1996 | Hyer | 222/241 |
| 6,264,043 | B1 * | 7/2001 | Mobley | 209/669 |
| 2005/0219943 | A1 * | 10/2005 | Yamane et al. | 366/77 |

* cited by examiner

*Primary Examiner*—Patrick H Mackey
*Assistant Examiner*—Kalyanavenkateshware Kumar
(74) *Attorney, Agent, or Firm*—Frank J. Dykas; Derek Maughan; Dykas, Shaver & Nipper, LLP

(57) ABSTRACT

A sorter for sorting pieces of various diameters and lengths made up of a pair of shafts spatially disposed in parallel within a horizontal plane, each of these shafts having a tapered core to which is connected to a pair of flights. When the shafts are rotated, items placed upon the flights of the shafts are aligned and moved toward the second end of the shaft. When a piece reaches a location where it can tip upon one of the flights and the end of the piece no longer contacts a part of the adjoining flight, the piece will tip. When this piece now traveling between the flights reaches a location where the space between the tapered portions of the cones is sufficiently large so as to allow the potato to fall between the cones, the piece will fall and has thus been sorted for diameter. Larger items thus are sorted to a location further from the first end of the device and smaller items are sorted to a position closer to the first end of the device.

6 Claims, 9 Drawing Sheets

POTATO SORTING APPARATUS

PRIORITY

This application is a non-provisional application which claims the priority date from the provisional application entitled POTATO SORTING APPARATUS filed by George Mendenhall on Jun. 17, 2005 with application Ser. No. 60/691,525, the disclosure of which is incorporated herein by reference.

DESCRIPTION

BACKGROUND OF THE INVENTION

1. Field of the Invention

The present invention generally relates to food processing equipment and more particularly to a device for sorting food products by both length and diameter.

2. Background Information

Food processing involves the transformation of raw or partially processed products into a useable, consumer friendly food product. In order to process some items such as potatoes into commercial food products such as French fries, these potatoes need to first be sorted and selected according to both diameter and length so as to determine which potatoes are of the optimal processing size.

Generally, the optimal processing size of a potato is somewhere between 3 and 5 inches in length and has a diameter of between 2 and 4 inches. Potatoes which are smaller than this, or which are significantly larger than this, typically are unsuitable for processing in as much as they create products that are outside of the desired range and have reduced commercial value. In the case of potatoes, if they can be sorted by length, then the longer potatoes can be cut into shorter pieces before entering the processing line for production of French fries. For example, six to eight inch potatoes can be first cut in half, nine to ten inch potatoes may be cut into thirds, and so forth. The problem with conventional sorters is that they sort by diameter, and not by length. While there is generally a correlation between diameter and length, that is to say longer potatoes have a bigger diameter that is not always the case, in that long, small diameter potatoes do exist. If one is only sorting by diameter, long, small diameter potatoes will not be sorted out. This can significantly reduce the value of a production run.

In order to obtain the most commercially valuable products, potatoes must be sorted so as to insure that appropriately sized potatoes are processed together. This batching insures that the optimally sized potatoes are run together and increases the value of that batch of product which is created by the use of those specifically sized potatoes.

In typical embodiments, the cutters for these potatoes utilize a hydraulic pump which pumps potatoes suspended within a liquid through a series of cutting blades. These cutting blades are adapted to cut or slice the potato when the potato is hydraulically propelled through these devices. Potatoes of an improper size have the ability to enter these cutters incorrectly and can result in potato pieces which are misshaped or too small or too long. Misshaped or too long pieces can then be subject to breaking and other associated problems which in turn can cause the commercial value of these pieces to be reduced. In addition, potatoes, which are too long or thick, can also in some circumstances, jam the cutter thus creating damage to equipment and resulting in the loss of commercial processing time. In order to avoid many of these problems these raw products need to be sorted prior to processing.

Mechanical sorting mechanisms exist in the prior art, however these devices sort only upon the characteristic of width, and many are incapable of sorting the potato which comes through in a non-linear or altered orientation and therefore results in the cutting of improper potato pieces. Electronically controlled sorting devices also exist in the prior art; however, they are expensive and usually only sort by one criteria such as length, weight, color or whatever criteria is most important.

Therefore what is needed is a device which enables potatoes and other vegetable products such as cucumbers, zucchini, or the like, to be sorted based upon both their length and their diameter into various sized bins or batches which can then be processed into the desired end products. Another need which exists is the ability to sort potatoes according to both length and diameter in a way which is significantly more efficient than other sorting devices. Embodiments of the present invention meet some or all of these needs.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a sorter for sorting pieces of various diameters and lengths according to their respective diameters and lengths. The invention is made up of a pair of shafts spatially disposed in parallel within a horizontal plane. Each of these shafts has a first end configured for operative connection with a rotating device such as a motor. Each of these shafts then extend along a length to a second end. Between the first end and the second end of the shafts, the body of the shafts have a tapered cone to which is connected a pair of concentric flights. Within this pair of flights, a first flight, and a second flight exist in an interspaced relationship. The first flight having a greater major diameter than the second flight. These flights extend toward the more narrow tapered end of the cones.

When the shafts are rotated, items placed upon the flights of the cones are aligned and moved toward the second end of the shaft. The second flight acts as a fulcrum upon which items are aligned and balanced between the pairs of the first flight. When a piece reaches a location where it can tip about the fulcrum of the second, or minor flight, and the end of the food piece no longer spans two parts of the first flight, the food piece will tip off of the first flight. This food piece has thus been sorted for length. When this food piece, which is now traveling between the first flights, reaches a location where the space between the tapered portions of the cones (screw sections) is sufficiently large so as to allow the food piece to fall between the cones, the food piece has then been sorted for diameter.

As these items move toward the second end of the shaft, the spaces between the flights or pitch increases as the cone body tapers. Shorter items with smaller diameters therefore fall through these spaces nearest to the first end of the device, and longer items with larger diameters move along the flights toward the second end. Items that are longer than the designated distance between the flights or pitch, will pass beyond the second end of the device where they may be recovered and collected in a container or collected for disposal according to the needs and desires of a user.

In the preferred embodiment the shafts and motor are connected to a frame, which is configured to maintain the shafts in a desired parallel orientation within a horizontal plane suspended above designated collection bins. An inclined plane may also be used. A pair of parallel guides is positioned above the shafts so as to direct items to be sorted into a desired position upon the flights between the shafts. Items can be brought to the first end of the sorter by a hopper, which is configured for placement above the first end of the shafts. The hopper is configured to place items to be sorted upon the flights near the first end of the shaft. Catch bins are located beneath the frame and are configured to catch and separate items sorted by the sorter.

This configuration allows items to be brought from the hopper and forced downward upon and through the parallel guides upon the flights and the shafts, as the shaft rotates these items are aligned and caused to travel from the first end of these shafts toward the second end of these shafts upon the flights. Potatoes or other items that have larger lengths and diameters are suspended upon the flights while smaller items fall between the flights and into the catch bins as the shaft tapers down and the space between the flights increases and larger items are permitted to fall. This system thus sorts smaller items out of a mixture first, near the first end of the device, and leaves larger and longer items to pass on toward the second end.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein we have shown and described only the preferred embodiment of the invention, simply by way of illustration of the best mode contemplated by carrying out our invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
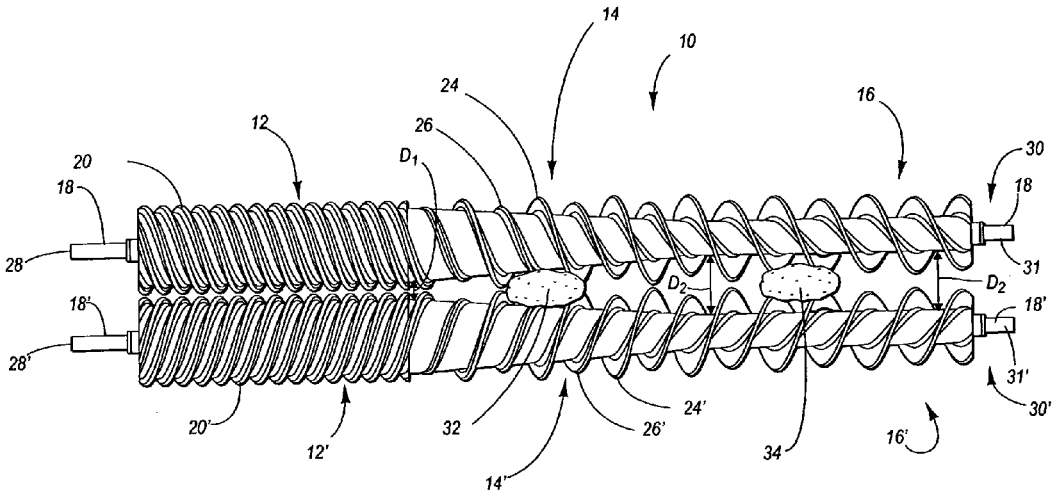
FIG. 1 is a top plan view of a typical pair of sorting rollers of the present invention.

While the invention is susceptible of various modifications and alternative constructions, certain illustrated embodiments thereof have been shown in the drawings and will be described below in detail. It is done in the context of sorting potatoes. The present invention will work for any number of food products where it is desirable to sort food products by both length and diameter, including, but not limited to cucumbers, zucchini, carrots and the like. It should be understood, however, that there is no intention to limit the invention to the specific form disclosed, and only to use with potatoes, but, on the contrary, the invention is to cover all modifications, alternative constructions, and equivalents falling within the spirit and scope of the invention as defined in the claims.

In order to clarify the relevance of definitions of various words used in the specification, the following definitions are provided and shown in FIGS. 1-9. The word flight refers to the helical threads 20, 24 and 26, which circumvolve the various screw sections. The word pitch, generally designated as 'P' in FIGS. 1, 3 & 4, refers to the distance between the same points on adjacent spirals of a flight. This is also the linear distance that the flight will travel in one revolution. Depth is the distance between the crest and the root of a flight measured perpendicular to the axis of the flight on one side and is generally designated as 'D' in FIGS. 3 & 4. The distance between roots on opposite sides of the flight is called the root or minor diameter. The distance between the crest on opposite sides of the thread is called the outside or major diameter.

Referring now to FIG. 1, there is shown a preferred embodiment consisting of a pair of composite roller assemblies 10, with each roller assembly having staging screw/core section 12, a tapered screw/core section 14 and a straight screw/core section 16. Herein, the terms "core section" and "screw section" are used interchangeably.

For illustration purposes only, the preferred embodiment described herein is designed to sort potatoes into four separate categories, including (1) those that are five inches or shorter and of an approximate diameter of less that two inches, (2) those that are five inches or shorter and of a diameter of between two and three inches, (3) those that are between five and six inches long and have a diameter of three inches or less, and (4) those that are longer than 6 inches and/or of a diameter greater than three inches. It should be readily apparent to those skilled in the art, that this is merely an example and that virtually any length and diameter sorting criteria could be used by simply varying the screw section geometries according to the present invention.

Figure 2:
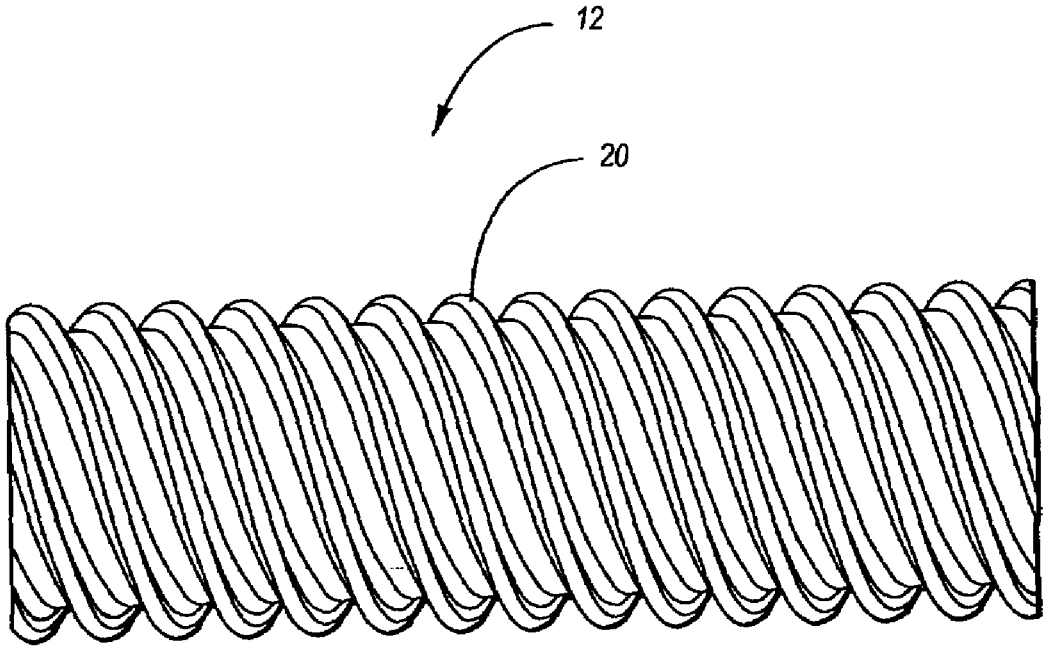
FIG. 2 is a side view of a staging screw section of the present invention.

Now referring to FIG. 1, shown are examples of a pair of sorting rollers 10 having staging screw section 12 and 12' having threads or staging flights 20 and 20' of a relatively short pitch. FIG. 2 shows the staging screw section 12 independently. Staging flights 20 and 20' used to separate the food product, in this case potatoes (32, 34), and align them longitudinally as they are conveyed along between the sorting rollers 10. In alternative designs, staging flights 20 and 20' could be of a variable pitch, starting with a tight pitch, and gradually and continuously increasing in pitch. This would serve to gradually accelerate, and thereby separate the potatoes as they advance along the staging screw. All screw sections, including the staging screw section, and the others hereinafter described, are formed with a central shaft bore, not shown, which permits these screw sections to be slid onto either of shafts 18 or 18', and secured thereto for rotational purposes, by means that are well known, and play no part of this invention.

Figure 3:
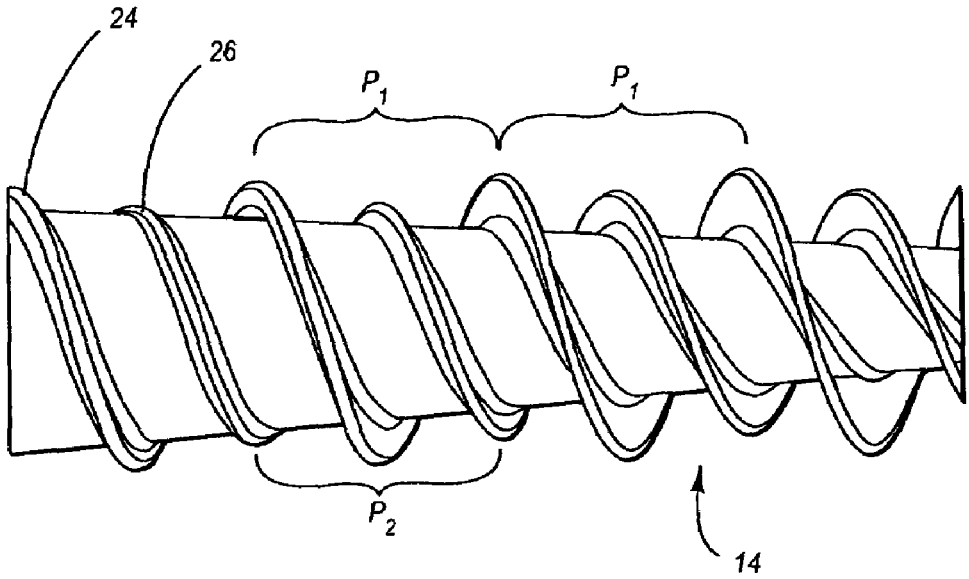
FIG. 3 is a side view of a typical tapered screw section of the present invention.

Tapered screw section 14 is shown to advantage in FIGS. 1 and 3. The second tapered screw section 14' is identical to tapered screw section 14 shown except that the flights as hereinafter described spiral in the opposite helical direction. Tapered screw section 14 has two flights formed integrally therewith, namely, major flight 24 and minor flight 26. The pitch, in this example is referred to as "$P_1$" and is set at slightly greater than five inches.

As shown in FIG. 1, the distance between the widest portions of tapered screw sections 14 and 14' is $D_1$ and is set in this example at one inch. As tapered screw sections 14 and 14' taper down, this distance expands to three inches at $D_2$, which in this example is set at three inches. The major diameter of major flight 24 remains constant, with the outward ends of the flights 24 and 24' remaining in close proximity to each other. In a like manner, the major diameter of the minor flight 26 also remains constant, although this is simply a matter of design choice, as it could be designed to be maintained at a constant depth relative to the surface of the tapered screw section 14.

When the two sorting roller assemblies 10 are counter-rotated away from each other, the major flights 24 and 24' appear to be advancing and function to center potatoes in the trough between them, and push each potato forward towards second end 30, as is shown with first potato 32 in FIG. 1. If potato 32 is less than five inches in length, it will drop between two consecutive potions of major flights 24 and 24' and rest on the interfitting portion of minor flights 26 and 26'. Minor flights 26 and 26' serve as a fulcrum for potato 32, and the center of gravity of potato 32 will be located on one side or the other of the fulcrum points of minor flights 26 and 26'.

If the diameter of potato 32 is less than three inches, then at some point the distance between tapered screw sections 14 and 14' will exceed the diameter of potato 32, and potato 32 will pivot around the fulcrum serving minor flights 26 and 26' and will drop more or less into a vertical orientation of its longitudinal axis and drop through tapered screw sections 14 and 14' into a collection bin or chute, not shown. This is shown representationally in FIG. 5, where potato 32 is being advanced by major flights 24 and 24', is fulcrumed on minor flights 26 and 26', and once there is sufficient distance between the tapered screw sections 14 and 14', will rotate about the points on the minor flights upon which it is resting, by force of gravity, and drop through.

If the collection bin or chute is divided into two collection bins or chutes at, for example, at a position below the tapered screw sections where the distance between 14 and 14' is two inches, then any potatoes which are less than five inches long, and two inches in diameter, will be sorted out from those that are less than five inches long and of a diameter between two and three inches. It should be obvious that the screw geometry can be adjust for sorting different dimensional parameters, depending upon the desires of the end user, and the food product being sorted.

Figure 4:
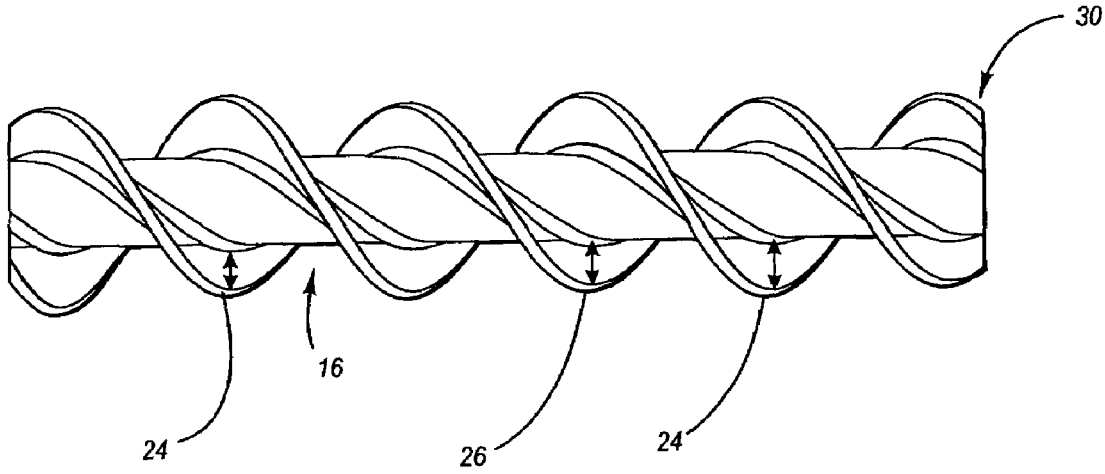
FIG. 4 is a side view of a typical straight screw section of the present invention.
Figure 5:
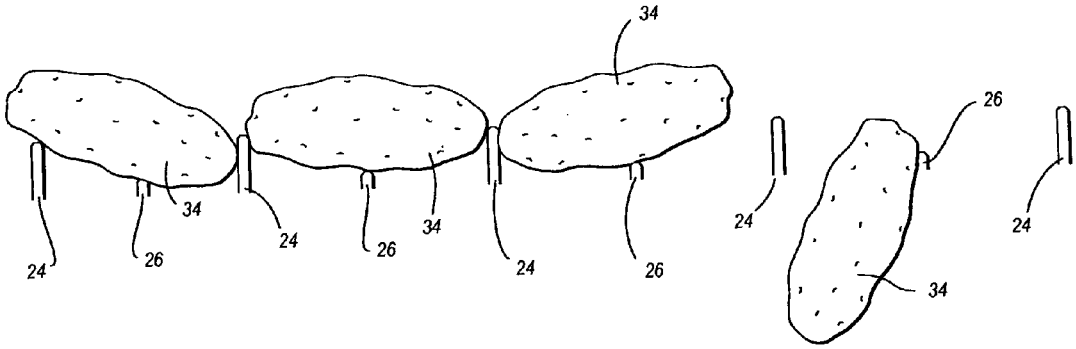
FIG. 5 is a representational side view of a potato dropping through a sorting screw section of the present invention.

In this example, any potato longer than five inches will ride atop the major flights 24 and 24' and not drop down onto the minor flights 26 and 26', and thus be carried along the entire length of tapered screw sections 14 and 14' to the next straight screw sections 16 and 16' as shown in FIGS. 1 and 4. Here the screw sections 16 and 16' are not tapered, rather, they are straight and remain at a constant distance $D_2$ from each other, which in this example is three inches. Major flights 24 and 24' and minor flights 26 and 26' are continued onto straight screw sections 16 and 16' uninterrupted from tapered screw sections 14 and 14'. However, the pitch, $P_2$ is different, and in this example $P_2$ is set at six inches. Again, sorting criteria can be easily changed by adjusting the geometry of the various screw section, however for illustrative purposes, it is set at six inches. Therefore, any potato longer that six inches will continue to ride atop the major flights 24 and 24', and be advanced off the ends 30 and 30' of sorting roller assemblies 10.

Any potato with a length between five and six inches will again drop between the major flights 24 and 24', and be propelled forward by the rear most points of major flights 24 and 24' as is the case with potato 34 shown in FIG. 1. If, in this example, the potato is less than three inches in diameter, it will drop through. If it is greater than three inches in diameter it will still drop between the major flights 24 and 24', however it will not drop through straight screw sections 16 and 16', but instead will be conveyed off the end along with those potatoes that are longer than six inches.

As is the case of tapered screw sections 14 and 14', the minor flights 26 and 26' have a constant major diameter, which for illustrative purposes in this example, is five inches. However, the major diameter of the major flights 24 and 24' start at the same six inches as they were configured on the tapered screw sections 14 and 14', they are gradually reduced to the same major diameter as that of the minor flight, namely five inches. This has the effect of tapering the major flights 24 and 24' away from each other as can be seen in FIG. 1. The purpose of this is to remove, or perhaps more accurately, withdraw the forward contact points on the major flights 24 and 24' which may be possibly in contact with a potato that is just long enough to drop between the major flights 24 and 24' but will bridge between two portions of both major flights and therefore hang up and not drop through to the collection bin.

Some of the variations in geometry mentioned above include extending the length of the various screw sections to facilitate less sloped tapering for finer diameter sorting, and the introduction of variable pitch flights, that for example could include straight screw sections 16 and 16' starting at a pitch of six inches and increasing to seven inches. Another variation would be including a number of tapered screw sections that include both tapered cones for diameter sorting and variable pitch for length sorting. For example, a tapered cone section for sorting potatoes six inches long and diameters of three inches or less from potatoes six inches long with diameters of between three inches and four inches or seven inches long with diameters of up to four inches. All of these variations should be apparent to those skilled in the art once the inventive concept is known.

Figure 6:
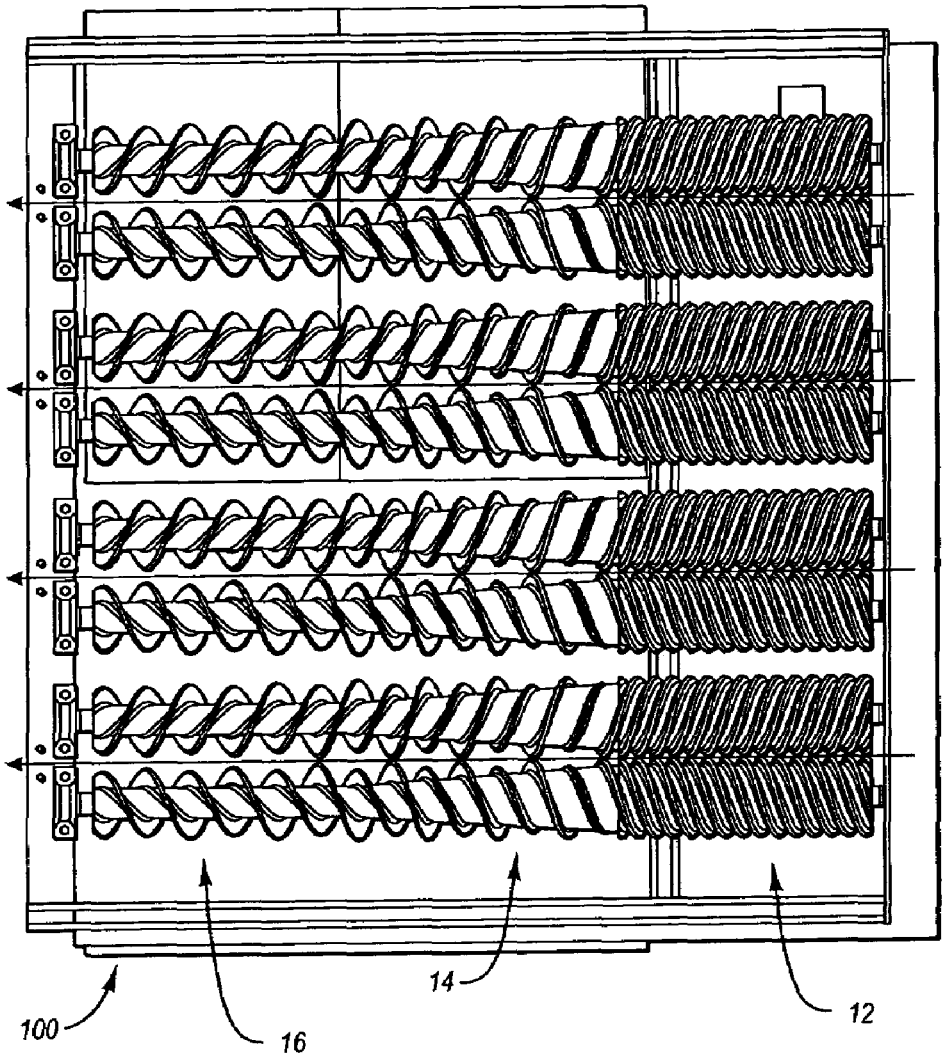
FIG. 6 is a top view of a number of roller assemblies of the present invention, as they would occur in another embodiment of the present invention.
Figure 7:
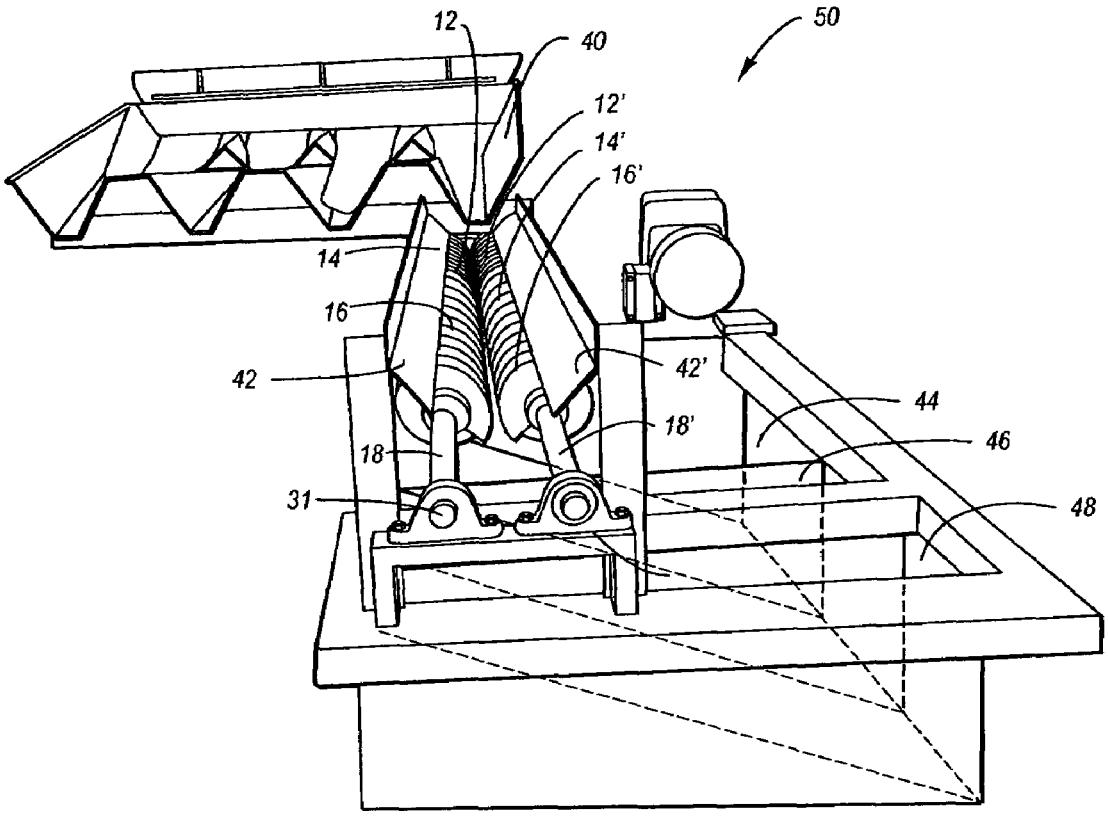
FIG. 7 is an end perspective view of another embodiment of the present invention.
Figure 8:
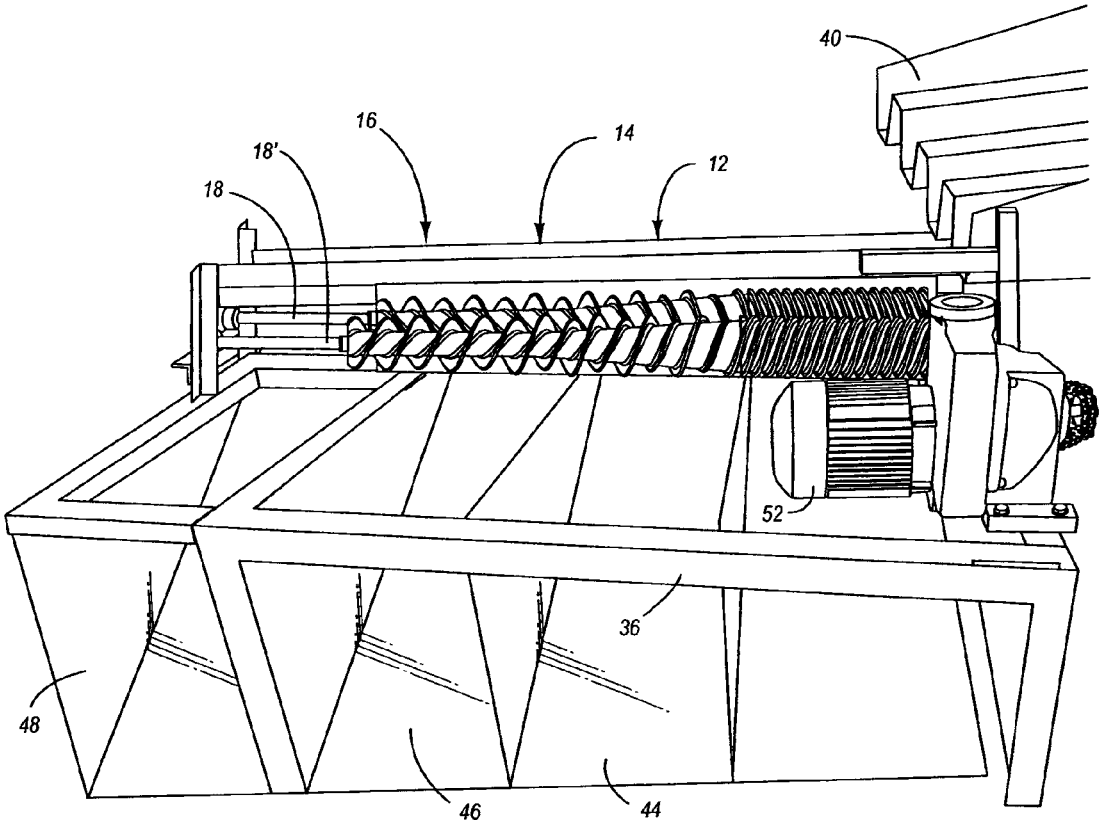
FIG. 8 is a side perspective view of the embodiment of FIG. 7.
Figure 9:
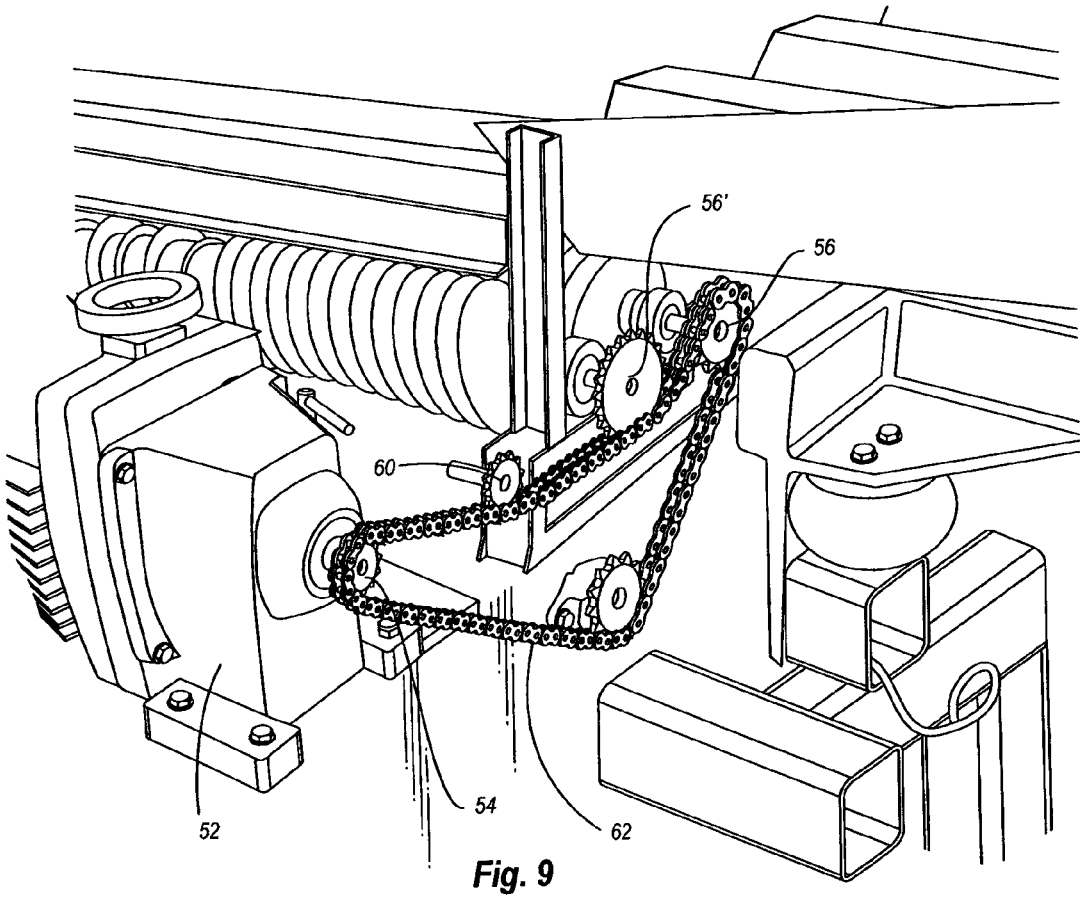
FIG. 9 is a partial, second end perspective view of the embodiment of FIG. 7.

FIG. 6 shows a sorting screw assembly 100 showing that a number of the units of the present invention, in use, could be placed in parallel. Referring now to FIGS. 7-9 a variety of views of a first working embodiment 50 of the present invention in a working embodiment is shown. It is formed of a pair of shafts 18, 18' wherein each of these shafts 18, 18' have a first end 28, 28' and extend along the length to a second end 31, 31'. Near the first end portion of shafts 18 and 18', staging portion 12, 12' are mounted as shown. The staging screw sections 12 and 12' each are provided with staging threads or flights 20 and 20' which counter-rotate toward each other, in a direction which appears to advance staging threads or flights 20 and 20' toward the second ends 30 and 30' of shafts 18 and 18'. Hopper assembly 40, of conventional and well known design and playing no part of this invention, is supplied with a continuous supply of potatoes, which are delivered in a conventional and sequential manner into the trough formed between the staging screw sections, where the potatoes are further aligned longitudinally and advanced as shafts 18 and 18' are rotated.

Attached to shafts 18 and 18' adjacent to staging screw sections 12 and 12', are tapered screw sections 14 and 14', and in a similar fashion, as shown representationally in FIG. 1, straight screw sections 16 and 16' are attached, to form sorting screw assemblies 10. These two sorting screw assemblies together form a single path through which the potatoes travel and are accordingly sorted as previously described. A pair of roller guards 42 and 42' are also provided to ensure that potatoes are not somehow carried by the screws, or somehow lifted out of the sorting path. In this illustrative embodiment, three collections chutes 44, 46 and 48 are provided to collect sorted potatoes and deliver them to transport conveyors, not shown, for further processing.

FIG. 9 shows an embodiment of a suitable chain drive system for counter-rotating screw assemblies 10. It utilizes gear reduction drive electric motor 52, drive sprocket 54, driven sprocket gears 56 and 56' attached to screw assemblies 10, idler sprocket gear 60, and drive chain 62. This is only one embodiment of a drive assembly. Others include geared transmission drives, hydromechanical drives, and a host of others.

In one particular example of the present invention, the present invention is a sorter for sorting items according to both diameter and length. The sorter comprising first and second shafts spatially disposed in parallel relationship within a horizontal plane. Each of these shafts having a first end and a second end. These shafts defining there-between a parallel pathway.

The first shaft having a first core portion circumvolving attached there-to for rotation in a first direction at a preselected distance from said parallel pathway. The second shaft having a second core portion circumvolving attached there-to for rotation in a direction opposite to said first direction at a preselected distance from said parallel pathway.

The first core portion having attached there-to and extending out there-from a first major helical flight having a preselected pitch and major diameter. This first major helical flight winding around the first core portion in a direction wherein the first major helical flight appears to be advancing along the aforementioned parallel pathway at a predetermined distance from the parallel pathway from the first end to the second end when the first core portion is rotated in the first direction.

The second core portion having attached there-to and extending out there-from a second major helical flight having a preselected pitch and major diameter identical to the preselected pitch and major diameter of said first major helical flight. The second major helical flight winding around the second core portion in a direction wherein the second major helical flight appears to be advancing along the parallel pathway at a predetermined distance from the parallel pathway when the second core portion is rotated in a direction opposite to the first direction.

Whereby rotation of the shafts, preferably in opposing directions, cause the flights to rotate and allows items placed upon the shafts to thusly be moved from the first ends toward the second ends between the shafts. As such, items having larger lengths and diameters are moved further along the shafts while items with smaller lengths and diameters fall between the flights.

It is further preferred that the shafts comprise a staging section connected to the shafts near the first ends, these staging sections comprised of a generally cylindrical body having a flight configured in a tight pitch so as to align items to be sorted in a desired orientation between the shafts. Further, the shafts preferably comprise extension portions connected to the shafts near the second ends, these extension portions each having a flight which decreases in its major diameter as the flight extends towards the second end. It is preferred that the shafts further comprise an extension portion near their second ends, these extension portions each having a flight which maintains the same major diameter as the flight extends along the shaft toward the second end.

It is further preferred that the present invention include at least one hopper configured for placement generally above the first end of the shafts, the hopper configured to place items to be sorted between the flights. Further, it is preferred that the present invention comprise at least one pair of parallel guides positioned above the shafts, these parallel guides configured to direct items to be sorted into a desired position between the shafts. It is also preferred that at least one catch bin be located beneath the shafts, this catch bin configured to catch and separate items sorted by the sorter. It is further preferred that the present invention comprise a frame 36 connected to the shafts, this frame configured to maintain the shafts in a desired parallel orientation within a horizontal plane.

The present invention provides significant advantage over the prior art in that this invention allows a user to selectively view and sort potatoes of a designated size by simply altering the portion of the shaft, which is desired. For example, in the first embodiment of the staging portion of the device could be generally uniform. The tapered cone portion of the extension portion can then be altered to vary the pitch of the flights so as to therefore vary the size of the potatoes which are selected for or against.

It should also be readily apparent that the number of pairs of screw assemblies can be increased, and all driven by a common drive system, and supplied with product to be sorted by a common feed or hopper system. In practice it is thought that four to six pairs of screw assemblies assembled in a parallel arrangement over common bins should provide sorting capacity for current processing systems.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A sorter for sorting items of various diameters and lengths according to their respective diameters and lengths comprising:

a pair of shafts spatially disposed in parallel within a horizontal plane, each of said shafts having a first end and extending along a length to a second end; each of said shafts having:

a staging portion located near said first end, said staging portion comprised of a generally cylindrical body having a flight configured in a tight pitch so as to align items to be sorted in a desired orientation between said shafts;

a tapered core portion having a first flight and a second flight, said first flight having a greater major diameter than said second flight, wherein said first flight and said second flight travel along said shaft generally toward an extension portion in the same rotational direction;

wherein said extension portion is positioned near said second end, said extension portion having a flight which maintains the same major diameter as said flight extends along said shaft toward said second end;

a portion configured for connection with a drive means, said drive means configured to rotate said shafts in opposing directions; and whereby rotation of said shaft causes said flights to rotate and causes items placed upon said shafts to be moved from said first end toward said second end between said shafts, items having larger lengths and diameters are moved further along said shafts while items with smaller lengths and diameters fall between said shafts.

2. The sorter of claim 1 further comprising: at least one hopper configured for placement above said first end of said shafts, said hopper configured to place items to be sorted between said flights.

3. The sorter of claim 1 further comprising: at least one pair of parallel guides positioned above said shafts, said parallel guides configured to direct items to be sorted to a desired position between said shafts.

4. The sorter of claim 1 further comprising: at least one catch bin located beneath said shafts, said catch bin configured to catch and separate items sorted by said sorter.

5. The sorter of claim 1 further comprising a frame connected to said shafts, said frame configured to maintain said shafts in a desired parallel orientation within a horizontal plane.

6. A sorter for sorting items of various diameters and lengths according to their respective diameters and lengths comprising:

a pair of shafts spatially disposed in parallel within a horizontal plane, each of said shafts having a first end and extending along a length to a second end; each of said shafts having a staging portion located near said first end, said staging portion comprised of a generally cylindrical body having a flight configured in a tight pitch so as to align items to be sorted in a desired orientation between said shafts; a tapered core portion, having a first flight, and a second flight, said first flight having a greater major diameter than said second flight, wherein said first flight and said second flight travel along said shaft generally from said staging portion toward an extension portion in the same rotational direction; wherein said extension portion is positioned near said second end, said extension portion having a flight which maintains the same major diameter as said flight extends along said shaft toward said second end; a portion configured for connection with a drive means, said drive means configured to rotate said shafts in opposing directions;

at least one frame connected to said shafts, said frame configured to maintain said shafts in a desired parallel orientation within a horizontal plane;

at least one pair of parallel guides positioned above said shafts, said parallel guides configured to direct items to be sorted to a desired position between said shafts;

at least one hopper configured for placement above said first end of said shafts, said hopper configured to place items to be sorted between said flights, and at least one catch bin located beneath said shafts, said catch bin configured to catch and separate items sorted by said sorter;

whereby items to be sorted are brought from the hopper and forced downward upon the first ends of the staging portion of the shafts, as the shaft rotates these items are aligned and caused to travel from said first end toward said second end between said shafts, items having larger lengths and diameters are suspended upon said flights while smaller items fall between said flights and into said catch bin, as the shaft tapers the space between the flights increases and larger items are permitted to fall, this system thus sorts smaller items out of a mixture first near the first end of the device and leaves larger items to pass on toward the second end.

* * * * *